US005257795A

United States Patent [19]

Babcock

[11] Patent Number: 5,257,795

[45] Date of Patent: Nov. 2, 1993

[54] SKATE BRAKING SYSTEM

[76] Inventor: Martin Babcock, 2214 Tower Ct., Woodbury, Minn. 55125

[21] Appl. No.: 969,980

[22] Filed: Nov. 2, 1992

[51] Int. Cl.[5] ..... A63C 17/14

[52] U.S. Cl. ..... 280/11.2; 280/11.22

[58] Field of Search ..... 280/11.2, 11.21, 11.22, 280/11.23, 11.27, 87.042; 188/5, 25

[56] References Cited

U.S. PATENT DOCUMENTS

| | | | |
|---|---|---|---|
| 333,751 | 1/1886 | Harris, Jr. | 280/11.2 |
| 1,371,623 | 3/1921 | Ickenroth | 280/11.2 |
| 1,402,010 | 1/1922 | Ormiston | 280/11.2 X |
| 1,456,881 | 5/1923 | Carley | 280/11.2 |
| 1,810,380 | 6/1931 | Van Etten | 280/11.2 |
| 2,644,692 | 7/1953 | Kahlert | 280/11.2 X |
| 3,884,486 | 5/1975 | Wilje | 280/11.2 |
| 4,288,088 | 9/1981 | Harrison | 280/11.2 X |
| 4,807,893 | 2/1989 | Huang | 280/11.2 |
| 5,067,736 | 11/1991 | Olson et al. | 280/11.2 |
| 5,088,748 | 2/1992 | Koselka et al. | 280/11.22 X |
| 5,183,275 | 2/1993 | Hoskin | 280/11.2 |
| 5,197,572 | 3/1993 | Roberts | 188/5 X |
| 5,207,438 | 5/1993 | Landens | 280/11.2 |

FOREIGN PATENT DOCUMENTS

| | | | |
|---|---|---|---|
| 62701 | 2/1949 | Netherlands | 280/11.2 |
| 96483 | 10/1922 | Switzerland | 280/11.2 |
| 11117 | of 1909 | United Kingdom | 280/11.2 |

*Primary Examiner*—Brian Johnson
*Attorney, Agent, or Firm*—Douglas L. Tschida

[57] ABSTRACT

A braking system for in-line skates including a spring biased, pivotally mounted skid pad and wheel pad. The system includes a bracket which mounted to a wheel track and to which a pad support arm is pivotally mounted. A flanged skid pad and flanged wheel pad mount to mating channels of the support arm. A leaf spring provides a controlled bias to the pad support arm, skid pad and wheel pad and provides a controlled stopping action without skidding.

11 Claims, 5 Drawing Sheets

SKATE BRAKING SYSTEM

BACKGROUND OF THE INVENTION

The present invention relates to skate brake systems and, in particular, to a system which is adaptable without appreciable modification to in-line skates.

Along with the expanding popularity of in-line skates has come a growing number of injuries that stem from the inefficient braking capabilities of such skates. Although protective safety padding can reduce the severity of physical injury, a need exists for an improved braking system. Such a system should be capable of accommodating a range of conditions from normal maneuvering to emergency braking. The brake system should also permit the skater to variably apply necessary friction without inducing skidding or loss of control.

Available brake systems principally provide a high durometer elastomer pad, commonly referred to as a skid pad, which is rigidly mounted to the toe or heel of a skate. Brake action is obtained by dragging or skidding the pad with an appropriate shifting of body weight over the skating surface to increase friction and slow skater momentum. A skater may also slow momentum by dragging the edges of one or more wheels of a trailing skate along the ground surface. Although such mechanisms and techniques slow the skater's momentum, depending upon the ground surface, the skid pad or wheels may be prematurely damaged and require replacement. Skidding or intermittent braking action may also destabilize the skater.

Any solution to the problem must therefore take into account the materials and the dynamics of skating and the necessity of not only stopping the skater, but also maintaining stability through the stopping action. Other considerations relate to increasing the surface area of frictional contact, selection and placement of friction enhancing materials and the wear characteristics, cost and ease of replacement of any brake assembly.

In addition to skid pads, a variety of systems have been developed for application with traditional roller skates, skate boards and in-line skates. Some of such systems are disclosed in U.S. Pat. Nos. 5,067,736, 5,053,102, 5,028,058, 4,909,523, 4,453,726, 4,275,895 and 3,884,486.

One assembly having some general similarities to the present invention is disclosed in U.S. Pat. No. 5,088,748 where a multi-arm linkage assembly and pivotally mounted trailer wheel are disclosed for in-line skates. Brake pads mounted to some of the arms cooperate with hardened braking hubs, which project from a brake wheel, and a spring biased linkage to effect braking upon exerting pressure on the trailer wheel. Others of the foregoing references also disclose special purpose hubs which cooperate with mating brake pads.

In distinction to known brake systems, the present invention provides an assembly which augments the braking capabilities of a drag or skid pad with a controlled frictional engagement of the rolling surface of one or more skate wheels.

SUMMARY OF THE INVENTION

It is accordingly a primary object of the invention to provide a wheeled skate brake system which provides a progressive stopping action to one or more skate wheels upon engaging a friction pad with the ground surface.

It is a further object of the invention to provide a system which includes a ground engaging friction pad which cooperates with a separate wheel engaging pad.

It is a further object of the invention to provide a braking system including means for spring biasing the brake assembly away from ground and wheel contact during normal skating, but which assembly during braking progressively first engages the ground surface and then one or more wheels as the skater applies increasing pressure to the ground pad.

Various of the foregoing objects, advantages and distinctions are particularly obtained in a presently preferred construction which provides a mounting bracket that mounts to the aft end of a wheel support track assembly. A brake pad support arm pivotally mounts to the bracket and contains a ground engaging friction pad and a wheel engaging friction pad. A leaf spring biases the support arm and wheel pad away from wheel contact, as the bracket restricts arm movement to prevent ground contact by the skid pad.

The pad support arm includes first and second channels which cooperate with flanged projections which extend from the ground pad and wheel pad. Alternative wheel pads are disclosed which engage the ground contacting surface of the wheel and/or sidewall wheel surfaces to, in combination with the ground pad, provide controlled stopping through progressive frictional engagement of the ground and stoppage of one or more wheels.

Still other objects, advantages and distinctions of the invention will become more apparent from the following description with respect to the appended drawings. The invention is described in relation to presently preferred constructions and considered modifications and improvements. The description should not be interpreted in strict limitation to the disclosure. Rather, the invention should be interpreted within the range of equivalent structures disclosed therein and claimed in the appended claims.

DESCRIPTION OF THE PREFERRED EMBODIMENT

Figure 1:
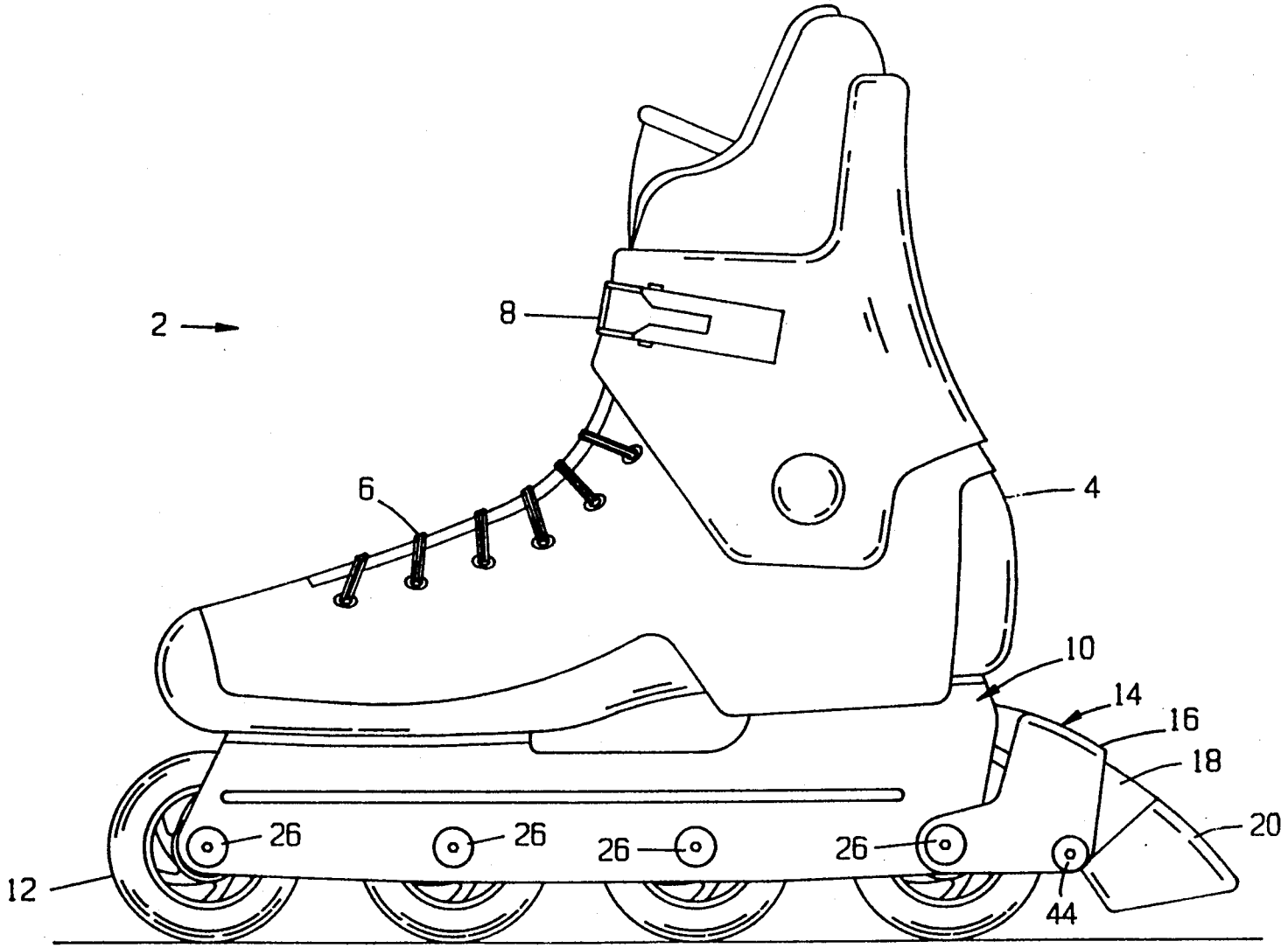
FIG. 1 is an elevation drawing of an in-line skate including the present invention.

Referring to FIG. 1, an elevation drawing is shown of a typical in-line skate 2 which are available from a number of manufacturers. The skate 2 generally includes a boot portion 4 that surrounds and protects the foot of a skater. Laces 6 and/or buckled fasteners 8 secure the boot 4 to the foot. Cushioning provided within the boot 4 protects and restrains the foot in generally immobile relation to the boot 4.

Projecting from the base of the boot 4 is an inverted V-shaped track assembly 10. Mounted along the length of the track 10 are a number of wheels 12. Each wheel 12 is supported from an axle. Roller bearings (not shown) may be included at the wheel/axle interface to improve skate performance.

Figure 2:
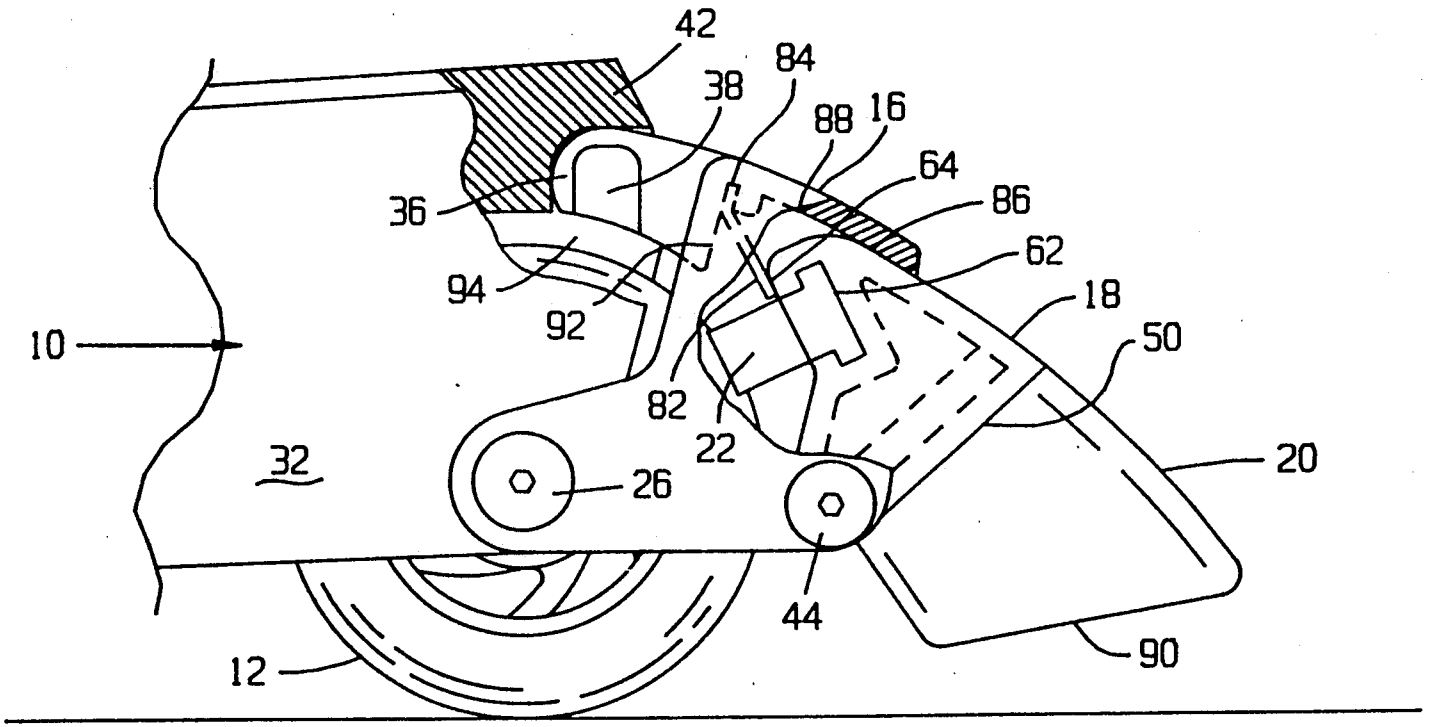
FIG. 2 is a detailed elevation drawing shown in cutaway of the brake assembly of the invention.

Appended to the aft end of the track assembly 10 is a brake assembly 14 which includes a mounting bracket 16 that is rigidly secured at two points to the track assembly 10. Pivotally secured to an aft end of the bracket 16 is a pad support arm 18 and from which a skid pad 20 extends. Also projecting from the pad support arm 18 is a separate wheel engaging pad 22 which mounts beneath the bracket 16. More of the details of the wheel pad 22 are shown at FIG. 2, which will be described below.

Although conventional skate assemblies have long provided skid pads, such pads are typically mounted in rigid relation to either the toe or heel of the skate. In contrast, the present invention provides a pivotally mounted skid pad and one which is spring biased in relation to the wheels 12. The capabilities of the brake assembly 14 are enhanced with the addition of the wheel pad 22. The wheel pad 22 cooperates with the ground pad 20 to slow skater momentum through an increase in skate-to-ground friction or drag and a reduced freedom of movement of one or more of the wheels 12.

Figure 3:
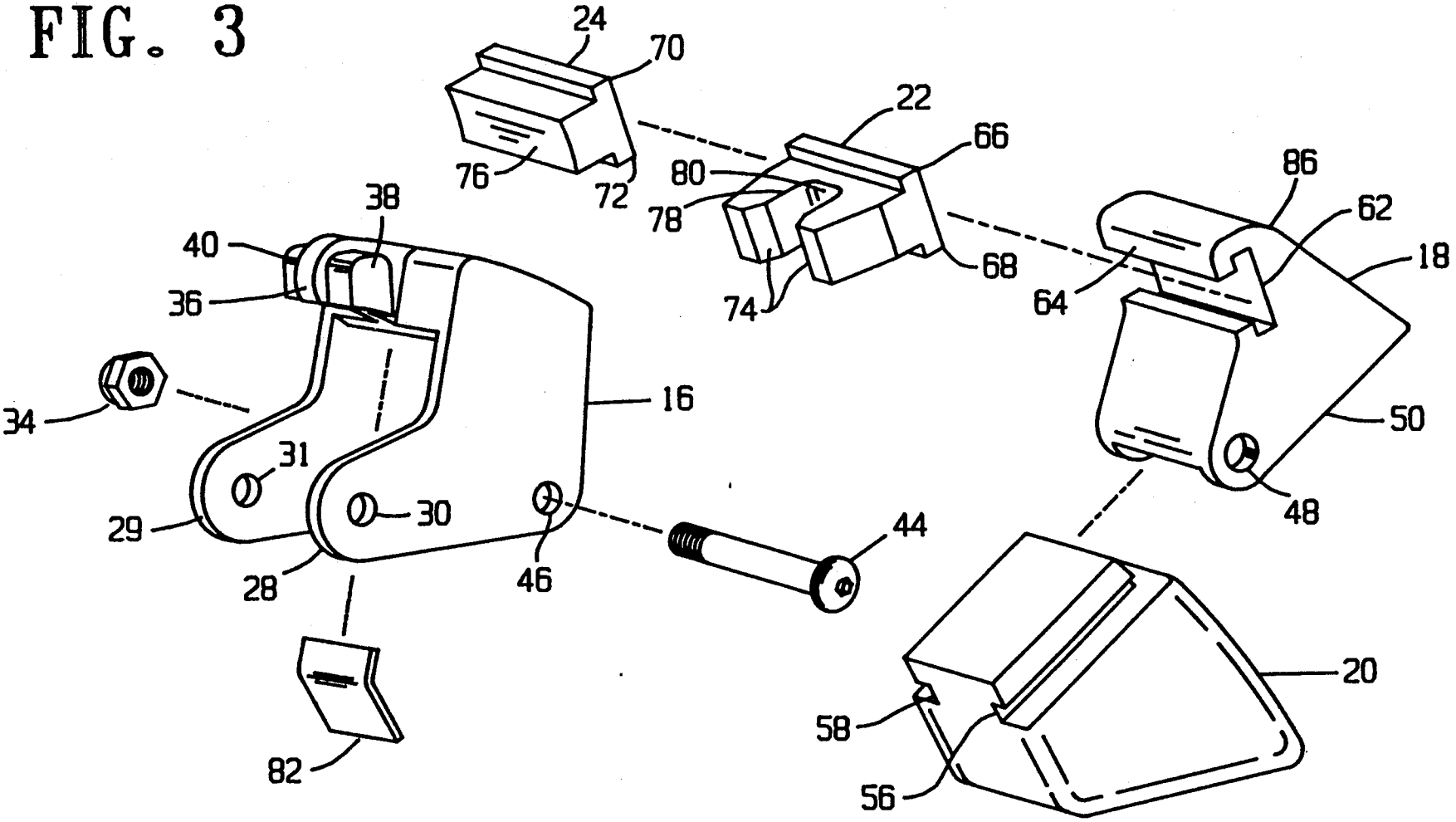
FIG. 3 is an isometric drawing shown in exploded assembly of the invention and further depicting alternative wheel pads.

In the latter regard, attention is directed to FIGS. 2 through 5 and wherein the details of the brake assembly 14 and particularly the mounting bracket 16, pad support arm 18, skid pad 20 and wheel pad 22 are depicted. FIG. 3 also discloses alternative configurations of the wheel pads 22 and 24. With attention first directed to FIGS. 2 and 3, the bracket 16 is secured at a lower end to the track assembly 10 via a bolt which acts as an axle 26. The axle 26 projects through vertical sidewall channels 32 of the track, bracket sidewalls 28 and 29 through apertures 30 and 31, as well as the aft wheel 12. A captive nut fastener 34 restrains the axle bolt 26 to the track 10 in conventional fashion. An upper end of the bracket 16 is secured to the track 10 via a projection 36 which includes a pair of transverse flanges 38 and 40 which mate with recesses or channels formed in the base 42 of the track assembly 10.

The pad support arm 18 is secured to the bracket 16 via a bolt fastener 44 which mounts through a pair of through holes at the aft end of the bracket 16. Only one of the through holes 46 is shown. The bolt 44 mates with a pair of aligned through bores 48, 49 provided in the pad support arm 18 to retain the arm 18 between the sidewalls 28, 29.

Figure 5:
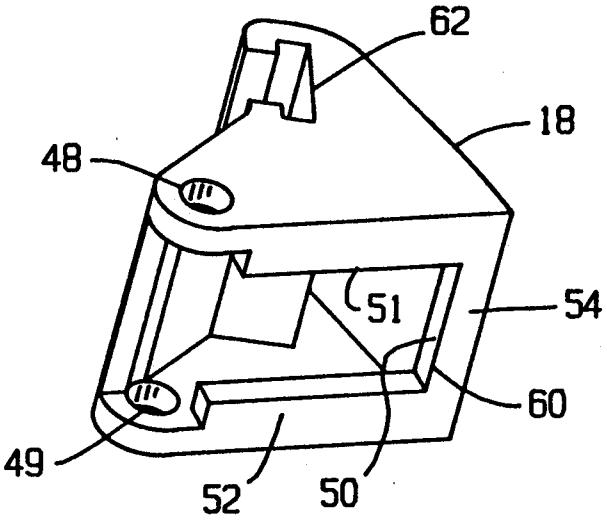
FIG. 5 is an isometric drawing showing the pivot arm rotated to expose the ground pad mounting channel.
Figure 4:
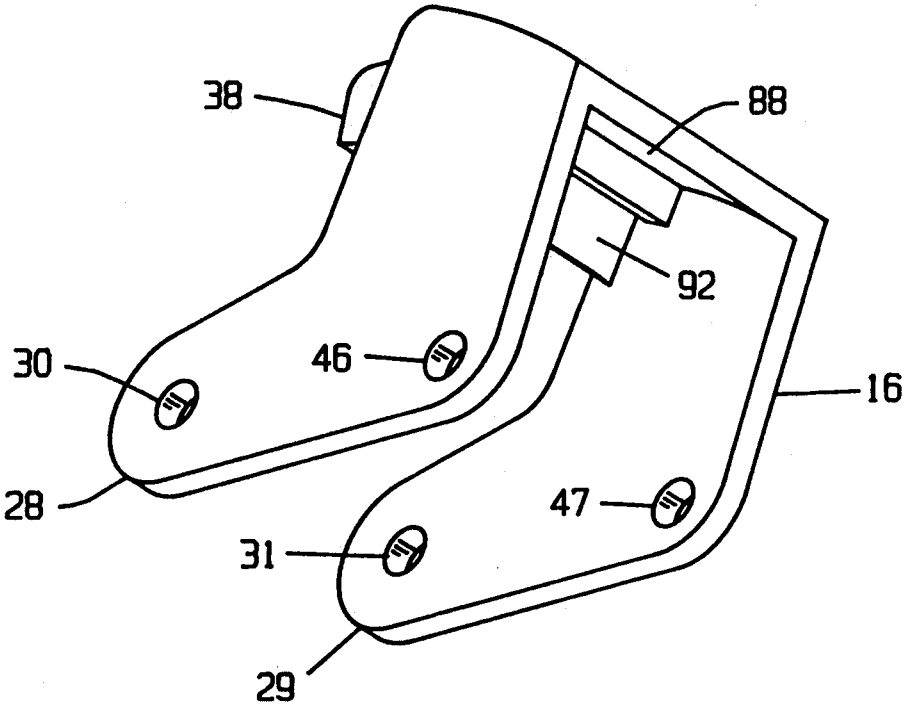
FIG. 4 is an isometric drawing showing the mounting bracket rotated to expose the pad support arm contact surfaces.

The skid or ground pad 20 is secured at a slide channel 50 of the bracket 18 to a pair of flanges 51 and 52 which project along a bottom surface 54 of the bracket 18 (reference FIG. 5). The flanges 51 and 52 mate with channels 56 and 58 cut into the ground pad 20. The ground pad 20 is restrained to the pad support arm 18 upon mating the flanges 50, 52 and channels 56, 58 to one another and inserting the pad 20 until fully seated against the surface 60 at the aft end of channel 50. The flanges 51, 52 and 60 in cooperation with the channels 56 and 58 permit ready replacement of the ground pad 20 upon removal of the fastener 44.

Although the fastener 44 must presently be removed to effect a changing of the ground pad 20, the holes 48, 49 could be re-positioned to permit pad changes without fastener removal by merely raising the holes along the arm 18. Because normal stopping forces are directed rearward, in such instance, the pad would still be firmly retained to the arm 18.

The ground pad 20 is presently constructed of conventional elastomer materials to an appropriate durometer and composition for the normal skating surfaces. Varieties of materials and additives can be added to the pad to enhance wear and/or frictional characteristics. The pad composition must take into account the wear surfaces, the weight of the skater and braking frequency.

A further channel 62 is provided in a surface 64 of the pad support arm 18. The channel 62 is shaped to receive mating flanges 66, 68 which project from the wheel pad 22 and flanges 70, 72 which project from the alternative wheel pad 24. Once either of the wheel pads 22 or 24 are mounted to the pad support 18, the track sidewalls 28, 29 prevent lateral displacement of the pads, except for minor lateral movement which self-centers the pads 22, 24 to the wheel.

The pad 22 provides a pair of beveled surfaces 74 which frictionally contact the sidewalls of the wheel 12, to either side of the center ground contact surface of the wheel 12. Otherwise, the pad 24 provides a brake surface 76 which contacts only the ground contact surface of the wheel 12. Depending upon the depth of the recess 78 at the pad 22, a surface 80 of the pad 22 may also contact the wheel 12. The material used to fabricate the pads 22 and 24 is selected to be compatible with the skate wheels 12. Preferably, the pads 22, 24 engage the wheels without inducing undue wear at the braking surface. A typical pad material might comprise a high melt temperature resin or plastic or an aluminum alloy.

Rotation of the pad support arm 18 is controlled with a leaf spring 82 which mounts to a groove 84 let into the bracket 16. A surface 64 of the pad support arm 18 contacts the spring 82 to normally bias the arm 18 to a rest position and such that an arm surface 86 contacts an inner surface 88 of the mounting bracket 16 with the wheel pad 22 or 24 retracted from the wheel 12 and the ground pad 20 raised above the ground.

During braking maneuvers, the skater typically shifting his or her weight to cause the pad 20 to contact the ground. The braking surface 90 of the pad 20 first contacts the ground and provides an initial braking action by adding drag. The amount of drag added depends upon the spring constant of the spring 82. With progressively increasing pressure and the overcoming of the spring 82, the pad support arm 18 is rotated to induce contact between the wheel pad 22 or 24 and the wheel 12. A maximum braking pressure is obtained when the spring 82 is flexed to contact a stop surface 92 of the bracket 16 (reference FIG. 4). The brake assembly 14 thus permits the application of controlled braking forces which not only add drag to the skate 2 via the ground pad 20, but also prevent the rotation of one of the wheels 12.

Although a single wheel pad has been disclosed, it is to be appreciated that other brake constructions are obtainable for use with devices other than in-line skates wherein other wheel pads 22 or 24 can be mounted to engage others of the wheels 12, as the assembly 14 is progressively rotated into a braking condition. Such additional pads may be coupled to a linkage assembly which projects through the track base 42, along the track sidewalls 32 or in the space 94 between the wheels 12 and the base 42.

Figure 6:
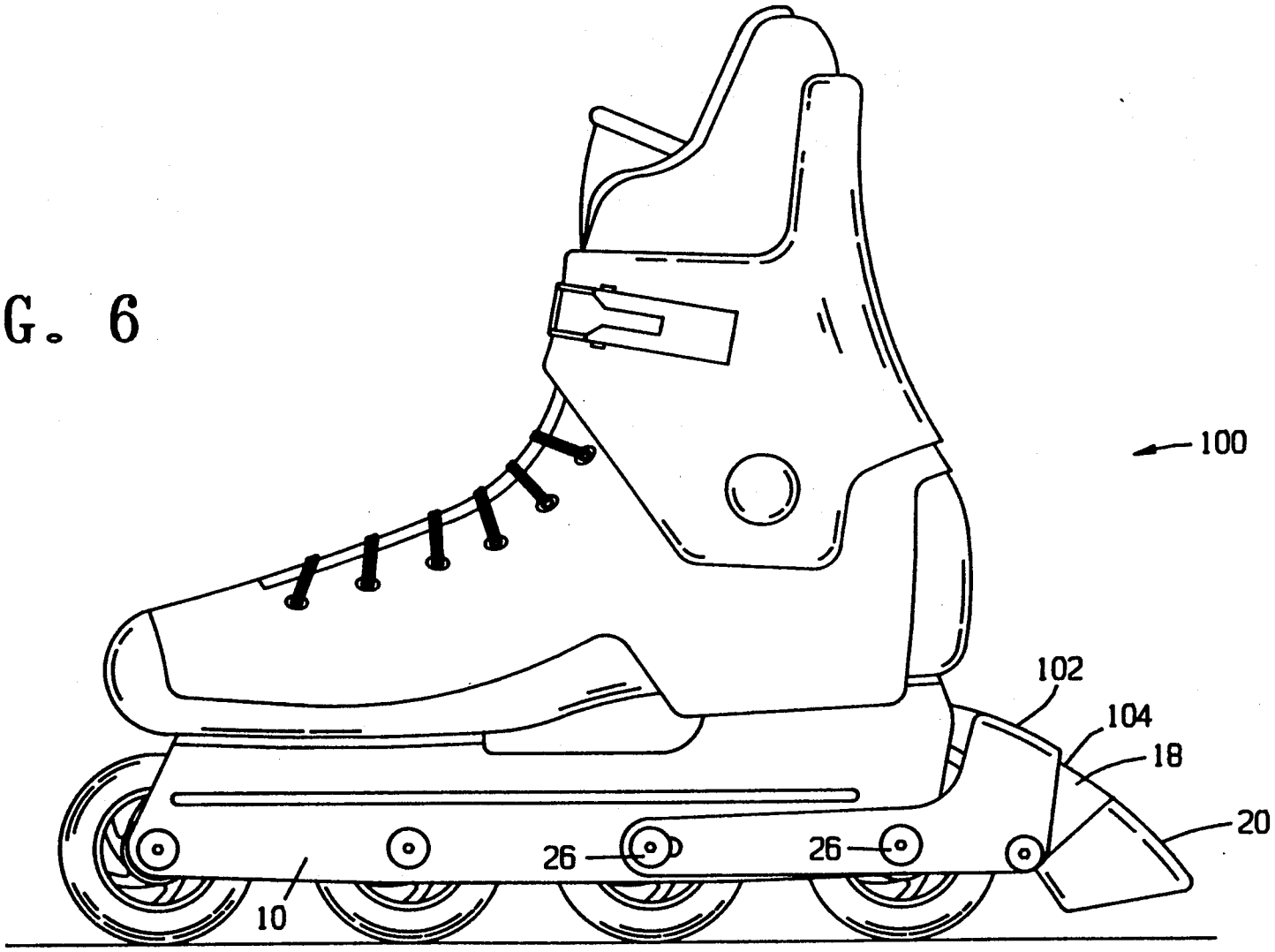
FIG. 6 is an elevation drawing of a skate assembly depicting an alternative mounting bracket which doesn't mount to the track base.

FIG. 6 lastly discloses an alternative skate construction 100 which includes a brake assembly 104 that mounts to an elongated bracket 102. The mounting bracket 102 is secured to the track assembly 10 at only a pair of axle bolts 26. That is, the bracket 102 does not include flanges 38 or 40 which mount to the base 42 of the track 10. Such a bracket 102 accommodates a wider range of skates. Otherwise, the brake assembly 104 is identical to that previously described and includes a pad support arm 18 and a ground pad 20 and wheel pad 22 or 24.

Although the invention has been described with respect to its presently preferred construction and various considered alternative modifications and improvements thereto, still other constructions may suggest themselves to those skilled in the art. The following claims should accordingly be interpreted to include all those equivalent embodiments within the spirit and scope thereof.

What is claimed is:

1. Braking apparatus for a skate device, comprising:

(a) a bracket including a first portion having first and second flange arms, which flange arms mount to both a wheel axle that extends through a wheel and a wheel support track and wherein first and second apertures are disposed in said first and second flange arms aft of said wheel, and said bracket having a second portion including at least one flange which mounts to a channel of the wheel support track;

(b) means pivotally securing to said bracket a first and a second brake means for stopping said skate device, comprising 1) a second axle mounted through said first and second apertures, 2) a pad support arm mounted to pivot about said second axle between an aft wall of said bracket and the wheel, wherein said first brake means projects from a first region of said pad support arm to contact said wheel and said second brake means projects from a second region of said pad support arm to contact a wheel support surface; and (c) spring means mounted to project from said bracket and contact said pad support arm for biasing said pad support arm to a rest position in contact with said bracket where said second brake means is displaced from the wheel support surface and said first brake means is displaced from said wheel and such that upon engaging said second brake means with the wheel support surface said first brake means simultaneously pivots to engage said wheel.

2. Apparatus as set forth in claim 1 wherein said first and second brake means respectively comprise first and second brake pads and at least one of said first and second brake pads includes a pair of flanges.

3. Apparatus as set forth in claim 2 wherein the flanges of said at least one of said first and second brake pads mounts to a mating channel of said pad support arm.

4. Apparatus as set forth in claim 2 wherein said first brake pad includes a pair of channels which channels mount to flanges of said pad support arm.

5. Apparatus as set forth in claim 2 wherein said second brake pad includes a surface which contacts a ground engaging surface of said wheel.

6. Apparatus as set forth in claim 2 wherein said second brake pad includes a pair of surfaces which contact sidewalls of the wheel adjacent said wheel support surface.

7. Apparatus as set forth in claim 1 wherein said spring means comprises a leaf spring which projects from said bracket and contacts said pad support arm.

8. Apparatus as set forth in claim 1 wherein the pad support arm comprises a plurality of channels for receiving mating flanges of said first and second brake means and wherein said spring means comprises a leaf spring which is mounted to said bracket to bias rotation of the support arm between a first stop surface of the bracket at the rest position and a second stop surface of the bracket which defines the maximum rotation of said pad support arm.

9. Apparatus as set forth in claim 8 wherein said second brake means includes a pair of surfaces which contact sidewalls of the wheel adjacent a ground contacting wheel surface.

10. Braking apparatus for a skate device, comprising:

(a) a bracket including a first portion having first and second flange arms, which flange arms mount to a first axle that extends through both a wheel and a wheel support track and wherein first and second apertures are disposed in said first and second flange arms aft of said wheel, and said bracket having a second portion including at least one flange which mounts to a channel of the wheel support track;

(b) means pivotally securing at least one brake pad to said bracket for stopping said skate device upon engaging a wheel support surface comprised 1) a second axle mounted through said first and second apertures, 2) a pad support arm mounted to pivot about said second axle between an aft wall of said bracket and the wheel, wherein flanged surfaces of said brake pad and pad support arm couple said brake pad to said pad support arm; and (c) leaf spring means connected with said bracket to contact said pad support arm for biasing said pad support arm to a rest position in contact with a first stop surface of said bracket where said brake pad is displaced from the wheel support surface and a second stop surface of said bracket which defines therebetween a maximum rotation of said pad support arm.

11. Braking apparatus for a skate device, comprising:

(a) a bracket including a first portion having first and second flange arms, which flange arms mount to a wheel axle that extends through both a wheel and a wheel support track and wherein first and second apertures are disposed in said first and second flange arms aft of said wheel, and said bracket having a second portion including at least one flange, which extends from an aft wall of said bracket and mounts to a channel of the wheel support track;

(b) means pivotally securing to said bracket at least a first brake means for stopping said skate device upon engaging a wheel support surface comprising 1) a second axle mounted through said first and second apertures and 2) a pad support arm mounted to pivot about said second axle between said aft wall and the wheel and from which pad support arm said first brake means projects; and (c) leaf spring means mounted to project from said bracket and contact said pad support arm for biasing said pad support arm between a rest position in contact with a first stop surface of said bracket and a second stop surface of said bracket which defines therebetween a maximum rotation of said pad support arm.

* * * * *